US011246372B2

(12) United States Patent
Stanley et al.

(10) Patent No.: US 11,246,372 B2
(45) Date of Patent: Feb. 15, 2022

(54) GROUNDING FOOTWEAR

(71) Applicant: N-ION SPORTS TECHNOLOGY LIMITED, Liverpool (GB)

(72) Inventors: Adam Stanley, Liverpool (GB); Stephen Walsh, Liverpool (GB)

(73) Assignee: N-ION SPORTS TECHNOLOGY LIMITED, Liverpool (GB)

( * ) Notice: Subject to any disclaimer, the term of this patent is extended or adjusted under 35 U.S.C. 154(b) by 5 days.

(21) Appl. No.: 16/301,973

(22) PCT Filed: May 17, 2017

(86) PCT No.: PCT/GB2017/051369
§ 371 (c)(1),
(2) Date: Nov. 15, 2018

(87) PCT Pub. No.: WO2017/199020
PCT Pub. Date: Nov. 23, 2017

(65) Prior Publication Data

US 2019/0150555 A1 May 23, 2019

(30) Foreign Application Priority Data

May 19, 2016 (GB) ..... 1608783

(51) Int. Cl.

| | |
|---|---|
| ***A43B 7/36*** | (2006.01) |
| ***A43B 13/14*** | (2006.01) |
| ***A43C 15/16*** | (2006.01) |
| ***A43B 5/00*** | (2022.01) |

(52) U.S. Cl.
CPC ..... *A43B 7/36* (2013.01); *A43B 5/00* (2013.01); *A43B 13/14* (2013.01); *A43C 15/16* (2013.01); *A43C 15/161* (2013.01)

(58) Field of Classification Search
CPC ..... A43B 7/36; A43B 13/14; A43B 13/26; A43B 1/08; A43C 15/16; A43C 15/161; A43C 15/167
USPC ..... 361/223, 224
See application file for complete search history.

(56) References Cited

U.S. PATENT DOCUMENTS 2,023,346 A * 12/1935 Temple ..... A43B 7/36 361/224
2,650,327 A * 8/1953 Legge ..... A43B 7/36 361/223
2,712,099 A * 6/1955 Legge ..... A43B 7/36 361/224

(Continued)

FOREIGN PATENT DOCUMENTS

DE 21 47 904 A1 3/1973
WO 91/00031 A1 1/1991

(Continued)

*Primary Examiner* — Heather Mangine
(74) *Attorney, Agent, or Firm* — Craft Chu PLLC; Andrew W. Chu

(57) ABSTRACT

The article of footwear for grounding the human body to earth includes a covered upper; a sole having an outer sole face distal from a user and an inner sole face proximate to the user; one or more electrically conductive portions which extend through the sole from the outer sole face to the inner sole face; and an electrically conductive layer which extends over a portion of the inner sole face and being configured to make conductive contact with the foot of the human body.

13 Claims, 6 Drawing Sheets

(56) References Cited

U.S. PATENT DOCUMENTS 2,857,556 A * 10/1958 Price ..... A43B 7/36 361/224
2,904,724 A * 9/1959 Mendoza ..... A43B 7/36 361/224
3,293,494 A * 12/1966 Fischer ..... A43B 7/36 361/224
3,302,227 A * 2/1967 Bente ..... A43C 15/16 12/142 P
3,383,559 A * 5/1968 Oesterheld ..... A43B 7/36 361/224
3,544,841 A * 12/1970 Peel ..... A43B 7/36 361/224
4,466,205 A * 8/1984 Corbari ..... A43C 15/161 36/134
4,727,452 A * 2/1988 Brownlee ..... A43B 7/36 361/220
4,812,948 A * 3/1989 Bird ..... A43B 7/36 361/223
5,576,924 A * 11/1996 Hee ..... A43B 7/36 361/223
5,653,047 A * 8/1997 Franey ..... A43B 7/36 36/136
6,219,942 B1 * 4/2001 Fini ..... A43B 1/0045 36/132
6,421,222 B1 * 7/2002 Maritz ..... A43B 7/36 361/223
6,549,391 B1 * 4/2003 Bisson ..... A43B 3/0005 361/223
7,471,497 B1 * 12/2008 Knight, Sr. ..... A43B 7/36 361/212
8,069,584 B2 * 12/2011 Wang ..... A43B 7/36 36/25 R
10,433,614 B1 * 10/2019 Dickerman ..... H05F 3/02
2002/0112375 A1 * 8/2002 Elsey ..... A43B 7/36 36/30 R
2002/0178619 A1 * 12/2002 Schaudt ..... A43B 5/02 36/128
2003/0230007 A1 * 12/2003 Walton ..... A43B 3/128 36/15
2007/0000155 A1 * 1/2007 Laufer ..... A43B 7/36 36/136
2007/0079527 A1 * 4/2007 Daniels ..... A43B 13/26 36/59 R
2008/0289217 A1 * 11/2008 Horvath ..... A43B 3/108 36/88
2015/0305447 A1 * 10/2015 Cavaliere ..... A43B 5/001 36/66
2016/0021981 A1 * 1/2016 Sanchez ..... A43B 13/26 36/134

FOREIGN PATENT DOCUMENTS

WO WO-9100031 A1 * 1/1991 ..... A43B 13/14
WO 01/87103 A1 11/2001
WO 02/26071 A1 4/2002

* cited by examiner

GROUNDING FOOTWEAR

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

This invention relates to grounding footwear. In particular, this invention relates to footwear that can be used to discharge extraneous static electricity and charges from an individual during sports and leisure activities.

2. Description of Related Art Including Information Disclosed Under 37 CFR 1.97 and 37 CFR 1.98

Interest in the practice of "grounding" or "earthing" the human body has grown in recent years. In the simplest form, the practice involves being in direct contact with the ground or earth by walking, sitting or lying (the terms "grounding" and "earthing" are interchangeable, and for brevity hereinafter will be referred to simply as "grounding" or the "ground"). When grounded in this manner, any extraneous static electricity, positive ions and other electromagnetic fields and charges that are present in the human body can be naturally dissipated to the ground. Grounding the human body on a regular basis allows it to dissipate all of the extraneous static electricity and charges that are accumulated whilst wearing manmade soles, and by living and working at elevated levels to the ground and allows an individual to harness or receive the negative ions that are present in organic materials, such as rain, trees, plants and minerals from the ground. Various scientific studies have pointed to a positive effect on the human psyche, and an improved general sense of wellbeing by the practice of grounding, as detailed below.

Researchers have found that sleeping on an electrically grounded conductive mat produced quantifiable changes in cortisol levels (Ghaly, M., Teplitz, D., "The Biologic Effects of Grounding the Human Body During Sleep as Measured by Cortisol Levels and subjective Reporting of Sleep, Pain and Stress", The Journal of Alternative and Complementary Medicine, Vol. 10, No. 5, 2004, pp. 767-776). This was found to improve sleep and reduce pain and stress in nearly all subjects. The practice of grounding has also been found to improve the symptoms of Seasonal Affective Disorder (SAD) and other types of depression (Terman, M., Terman, J. S., "Controlled Trial of Naturalistic Dawn Simulation and Negative Air Ionization for Seasonal Affective Disorder", American Journal of Psychiatry, Vol. 163, 2006, pp. 2126-2133).

In the area of sports science, the use of grounding (either through being in direct contact with the ground by walking, sitting or lying, or through the use of electrically grounded conductive mats or pads) has allowed sportsmen and women to recover more quickly after exercise, and to reduce pain and inflammation and have more energy. Studies have revealed that grounding to harness the negatively charged electrons and ions carried in the earth also reduces lactic acid build up that occurs during and after exercise (Brown, D., Chevalier, G., Hill, M., "Pilot Study on the Effect of Grounding on Delayed-Onset Muscle Soreness", The Journal of Alternative and Complementary Medicine, Vol. 16, No. 3, 2010, pp. 265-273).

In modern sports stadia, an athlete, such as a professional football player, is bombarded by a multitude of unseen charges, fields and frequencies which all stem from developments in terms of telecommunications and computerisation. For example, infrared radiation, wireless technology (WiFi), mobile telecommunications signals and networks, such 3G and 4G, and countless other digital and cellular signals received and transmitted by modern smartphones and electronic devices. In addition, the manmade non-conductive footwear of the modern athlete disconnects them from remaining grounded during this electromagnetic frequency (EMF) radiation bombardment, which can lead to a large inflammation build up during gameplay, and which could then either cause or compound existing injuries and possible chronic conditions in the athlete.

Therefore there is the need for a product that has the ability to not only connect the athlete to the ground, enabling his/her body's natural healing and recovery system to occur during active play, but which can also enhance the body's performance by aiding in the recovery process.

It is an object of the present invention to provide footwear that can be used to discharge extraneous static electricity and charges from an individual during sports and leisure activities. Such footwear alleviates the drawbacks associated with known non-conductive sports and leisure footwear, which provide no grounding effect. The present invention provides footwear that can be worn to give an improved sense of wellbeing. It is an object of the present invention to provide sports and leisure footwear and its method of manufacture which does not affect the mechanical and aesthetic properties of the footwear, nor does it significantly increase weight of the footwear. Use of the present invention helps to eradicate the effects of extraneous static electricity, positive ions and other electromagnetic fields and charges that are accumulated in the human body by naturally dissipating them to the ground to give an improved sports and/or athletic performance. Use of the present invention helps to aid the recovery and healing of the human body's natural equilibrium, to promote a balance in blood cell congestion and reduce inflammation. Use of the present invention is particularly beneficial for sportspersons who are prone to injury or who suffer from reoccurring chronic conditions.

BRIEF SUMMARY OF THE INVENTION

The present invention is described herein and in the claims.

According to the present invention there is provided an article of footwear for grounding the human body to earth, comprising:

a covered upper;

a sole having an outer sole face distal from a user and an inner sole face proximate to the user;

one or more electrically conductive portions which extend through the sole from the outer sole face to the inner sole face; and an electrically conductive layer which extends over a portion of the inner sole face and being configured to make conductive contact with the foot of the human body.

An advantage of the present invention is that it can be used to discharge extraneous static electricity and charges from an individual during sports and leisure activities Preferably, the sole is generally planar.

Further preferably, the outer sole face and the inner sole face are planar and parallel to each other.

In use, the sole may be rigid or semi-rigid and is formed from a resin, rubberised and/or hard plastics material.

Preferably, the one or more electrically conductive portions which extend through the sole from the outer sole face to the inner sole face are disposed in one or more integrally-moulded blades and/or raised protections for providing grip, or one or more stud receiving portions for receiving one or more complementary conductive threaded screw studs.

Further preferably, each of the stud receiving portions being formed from a separate suitable metal or rigid plastics material and in-moulded with the sole to receive the thread of each of the threaded screw studs.

In use, each of the threaded screw studs may have a body portion configured generally as a truncated cone or truncated pyramid and a shaft disposed through the body portion having at one end a thread which is dimensioned to be received in the stud receiving portion and an exposed ground contacting portion at the other end of the shaft.

Preferably, the shaft being formed from an electrically conductive material.

Further preferably, the electrically conductive material forming the shaft is selected from the group consisting, but not limited to, any one of the following: copper, silver, silver plated or coated steel, carbon fibre or an alloy or mixtures thereof.

In use, the body portion may comprise projections for engagement with a complementary shaped tool for fixture and/or replacement in the sole.

Preferably, the body portion comprises an annular shoulder which meets with the outer face of the stud receiving portion when fully screwed in.

Further preferably, disposed at the threaded end of each of the threaded screw studs is a low-profile lug or push-fit type connector, the lug or connector projecting through a slit or opening formed in the inner sole face when fully screwed in.

In use, the lug or connector may be connected to one end of an exposed conductive wire, the electrical connection of the wire to the lug or connector being via a physical spade connection and/or a crimp connection and/or a soldered connection.

Further preferably, disposed inside the threaded end of each of the threaded screw studs is a blind hole.

Preferably, the other end of the exposed conductive wire forms a loop connected to the lug or connector of a neighbouring threaded screw stud.

Further preferably, the conductive wire loop is positioned in a generally flat configuration adjacent to the inner sole face.

In use, the conductive wire loop may be positioned in a generally flat configuration contiguous with the inner sole face.

Preferably, a plurality of conductive wire loops are positioned adjacent to the inner sole face.

Further preferably, the number of conductive wire loops is three and the number of threaded screw studs is six.

In use, the conductive wire loop connected between neighbouring pairs of threaded screw studs may be C- or U-shaped.

Preferably, the conductive wire loop connected between neighbouring pairs of threaded screw studs is formed having a convoluted path.

Further preferably, the conductive wire loop being formed from copper, silver or alloys or mixtures thereof.

In use, the one or more threaded screw studs may be provided along the length of the outer sole face projecting therefrom in pairs, with a pair of threaded screw studs located generally around a heel portion, a pair of threaded screw studs located generally around a instep portion, and a pair of threaded screw studs located generally around an instep portion of the sole.

Preferably, the electrically conductive layer comprises a layer of conductive tape or fabric.

Further preferably, the layer of conductive tape or fabric is a copper or silver-based tape or fabric material.

In use, the layer of conductive tape may be embossed copper tape, with an acrylic pressure sensitive adhesive and liner.

Preferably, the embossed copper tape adheres the conductive wire loop in place.

Further preferably, the footwear further comprising an insole on top of the layer of conductive tape proximate to the user, the insole providing a cushioning layer formed from a woven fabric material that includes a conductive yarn selected from the group consisting, but not limited to, any one of the following: strands of copper, silver, carbon fibre and combinations thereof.

In use, the insole may be anatomically shaped to the foot of the user when in use.

Preferably, the one or more electrically conductive portions being disposed in one or more integrally-moulded blades and/or raised protections are portions or cylinders of conductive material which extend from the outermost part of the blade or raised projection to the inner sole face.

Further preferably, the portions or cylinders of conductive material are held in place in an aperture which extends from the outermost part of the blade or raised projection to the inner sole face via an interference fit or being adhered in place by the use of a suitable adhesive.

In use, the portions or cylinders of conductive material may be selected from the group consisting, but not limited to, any one of the following: copper, silver, silver plated or coated steel, carbon fibre or an alloy or mixtures thereof.

Preferably, the portions or cylinders of conductive material are formed integrally with the sole via ion beam mixing.

Further preferably, the article of footwear is selected from the group consisting, but not limited to, any one of the following: football shoes, tennis shoes, golf shoes, rugby boots, American football boots, hockey shoes, running spikes.

In use, the upper being formed from a conductive fabric material.

Preferably, the footwear further comprising a soluble coating being applied to the upper and the sole and which incorporates a conductive compound.

Also according to the present invention there is provided method of manufacturing an article of footwear comprising a covered upper or an upper configured to cover a wearer's foot or covered upper portion, and a sole having an outer sole face and an inner sole face, the method comprising the steps of:

inserting a plurality of electrically conductive portions completely through the sole from the outer sole face to the inner sole face;

securing the plurality of electrically conductive portions in place and electrically connecting the portions using exposed wire; and placing and adhering an electrically conductive layer on top of the exposed wire; and optionally placing a conductive insole over the electrically conductive layer.

It is believed that grounding footwear and its method of manufacture in accordance with the present invention at least addresses the problems outlined above.

It will be obvious to those skilled in the art that variations of the present invention are possible and it is intended that the present invention may be used other than as specifically described herein.

BRIEF DESCRIPTION OF THE SEVERAL VIEWS OF THE DRAWINGS

The present invention will now be described by way of example only, and with reference to the accompanying drawings.

DETAILED DESCRIPTION OF THE INVENTION

The present invention has adopted the approach of utilising footwear to discharge extraneous static electricity and charges from an individual during sports and leisure activities. Advantageously, the present invention provides footwear that can be worn to give an improved sense of wellbeing. Further advantageously, the present invention provides sports and leisure footwear and its method of manufacture which does not affect the mechanical and aesthetic properties of the footwear, nor does it significantly increase weight of the footwear. Use of the present invention helps to eradicate the effects of extraneous static electricity, positive ions and other electromagnetic fields and charges that are accumulated in the human body by naturally dissipating them to the ground to give an improved sports and/or athletic performance. Use of the present invention helps to aid the recovery and healing of the human body's natural equilibrium, to promote a balance in blood cell congestion and reduce inflammation. Use of the present invention is particularly beneficial for sportspersons who are prone to injury or who suffer from reoccurring chronic conditions.

Figure 1:
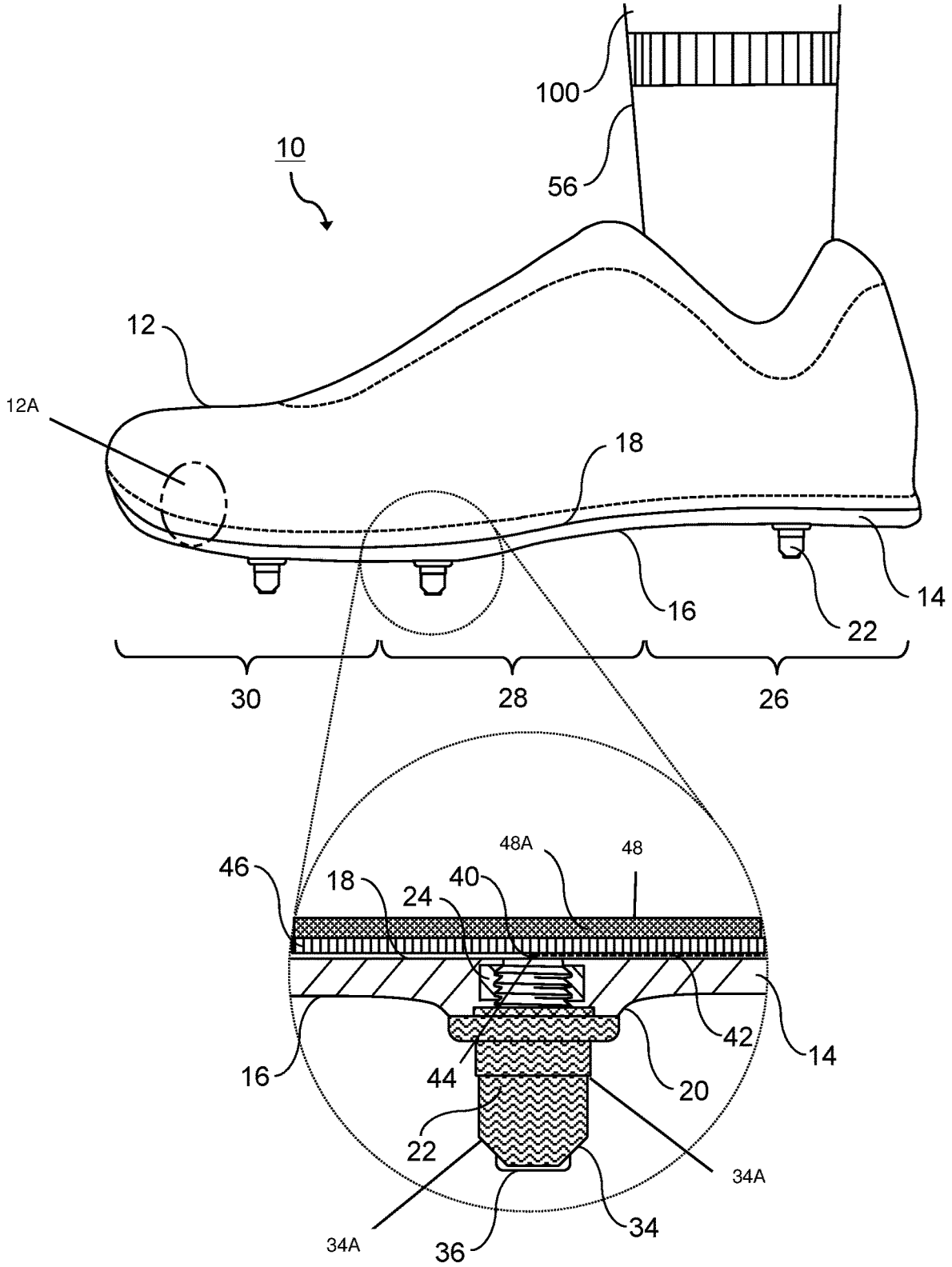
FIG. 1 is a side schematic view of the footwear in accordance with the present invention and which also shows a cross-sectional view from the side of the electrical grounding connection between the underside of studded sole to the user.
Figure 2:
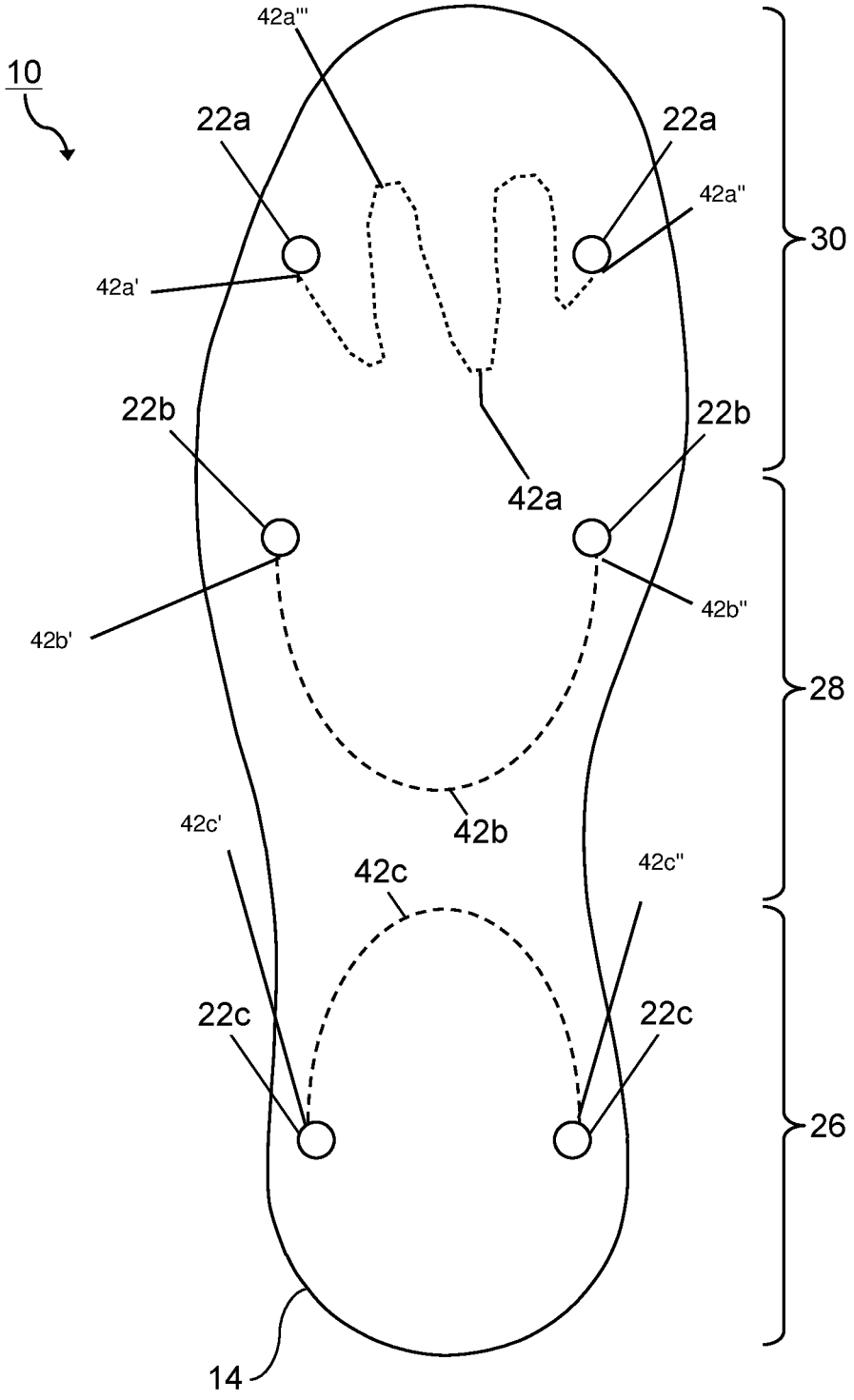
FIG. 2 shows a cross-sectional plan view from above of the top of the inwardly facing sole face of the footwear of FIG. 1.
Figure 3:
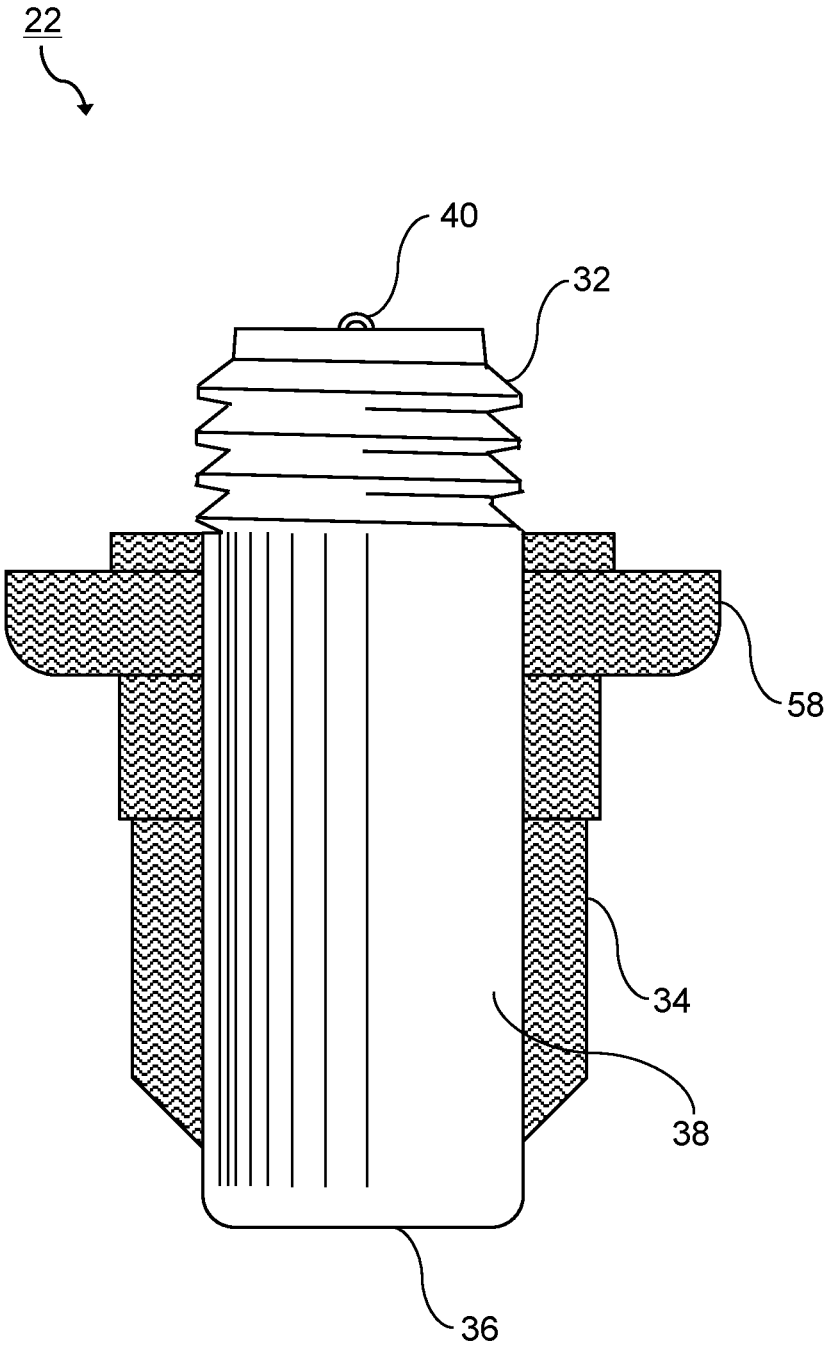
FIG. 3 illustrates a cross-sectional view from the side of a screw stud for use with the footwear of FIG. 1.

Referring now to the drawings, electrically grounded footwear or shoe 10 according to the present invention is illustrated in FIGS. 1 to 3. Specifically, the shoe 10 in this exemplary embodiment is described in relation to a screw studded football or rugby shoe. The shoe 10 has an upper 12 which is bonded to a sole 14. The sole 14 consists of a generally flat portion formed from a rigid or semi-rigid material, such as, for example, a moulded resin, rubberised or hard plastics material.

As shown in FIG. 1, the sole 14 is formed having two opposing faces which are generally planar and parallel to each other, having an outwardly facing sole face 16 at its underside and an opposite inwardly facing sole face 18 which is proximate to the user 100 when in use.

Depending upon the sport or leisure activity for which the shoe 10 is intended to be used, the outer sole face 16 may include integrally-moulded detents, raised protections or blades or other features for providing grip (as shown for example in the embodiment of FIGS. 4 and 5), or include one or more stud receiving portions 20 capable of receiving one or more complementary threaded screw studs 22.

To ensure a strong mechanical securement of the screw studs 22 to the outer sole face 16, a threaded aperture or threaded retaining insert 24 is in-moulded in the sole 14 to receive the thread 32 at one end of the screw stud 22, as best shown in FIG. 3. The threaded aperture or threaded retaining insert 24 can be integrally moulded with the sole 14 or formed from a separate suitable metal or rigid plastic material and in-moulded.

The plurality of screw studs 22 are provided along the length of the outer sole face 16 extending generally in pairs, at least through the heel portion 26, instep portion 28 and toe portion 30, as shown in FIGS. 1 and 2. The skilled person will appreciate that other configurations, including additional screw studs 22, can be positioned throughout the sole 14 and this is in no way intended to be limiting.

As best shown in FIG. 3, each of the screw studs 22 is configured as a truncated cone or truncated pyramid and include at one end a threaded portion 32 which is dimensioned to be received in the complementary threaded aperture or retaining insert 24 in the sole 14. The threaded portion 32 is fabricated from an electrically conductive material, such as copper, silver or silver plated or coated steel, or an alloy or mixtures thereof, and extends through the plastic body or body portion 34 of the stud 22 as a shaft 38 which is completely exposed at the opposite end 36 to the thread 32. In the exemplary embodiment of the invention shown in FIGS. 1 to 3, the body 34 of the screw stud is trilobulor, cruxiform or cone-shaped with projections 34A for engagement with a complementary shaped tool (not shown) for fixture and/or replacement. The body portion 34 also includes an annular shoulder 58 which meets with the outer face of the stud receiving portion 20 when fully screwed in. In a preferred embodiment, the threaded portion 32 and retaining inset 24 are provided having M4, M5 or M6 ISO metric screw threads.

The construction of the screw stud 22 can be via any suitable form of fabrication, i.e. the elongate metal bar or shaft 38 forming the threaded portion 32 at one end and the ground contacting base 36 at the other, can machined, pressed, cast or forged from a suitable conducting metal. The plastic outer stud body 34 is then moulded around the shaft, as best shown in FIG. 3. The skilled person will appreciate that the plastic outer stud body 34 can be manufactured using techniques such as injection or blow moulding, vacuum forming, rotational moulding, compression moulding, rim moulding, power impression moulding or any form of plastics manufacture.

The screw studs 22 are at least partly made of conductive material, copper, silver or alloys or mixtures thereof. Alternatively, the stud 22 can be made from other metallic or non-metallic conductive materials such as carbon fibre, which also has the added benefit of being lightweight. The above list is no way intended to be limiting and exhaustive. The fundamental attributes of the stud 22 require that the central shaft 38 to be of an electrically conductive material.

The threaded end 32 forms or defines a low-profile lug 40 or push-fit type connector at the top of the shaft 38. The lug 40 positioned at the threaded end 32 of the shaft 38 projects through a slit or opening 44 formed in the inner sole face 18, as best shown in the enlarged view of FIG. 1. The lug 40 is then connected to one end (42*a*', 42*b*', 42*c*') of a loop (42*a*, 42*b*, 42*c*) of exposed conductive wire 42 which is formed from copper, silver or alloys or mixtures thereof. The electrical connection of the looped wire 42 to the lug 40 of the stud 22 is via a physical spade connection or crimp or by soldering the wire 42 to the lug 40 of the screw stud 22.

The small hole or incision 44 made in the inner sole face 18 adjacent to the in-moulded retaining insert 24, allows the exposed wire 42 to been electrically connected to the ground contacting base 36 of the stud 22, and the wire 42 is then positioned in a generally flat configuration adjacent to the inner sole face 18, as best shown in FIG. 1.

As best shown in FIG. 2, an advantageous grounding effect is achieved when at least six electrically conductive studs 22 are positioned in the sole 14. A pair of studs 22*a* being positioned around the toe portion 30; a pair of studs 22*b* being positioned around the instep portion 28 and a pair of studs 22*c* being positioned around the heel portion 26. Each of these pair of studs 22*a*, 22*b*, 22*c* are electrically connected using looped wires 42*a*, 42*b*, 42*c*, respectively, as described below.

Each of the looped wires 42*a*, 42*b*, 42*c* form ends (42*a*', 42*b*', 42*c*', 42*a*", 42*b*", 42*c*") that are connected to the lugs 40 of the pairs of studs 22*a*, 22*b*, 22*c* secured in the receiving portions 20 as sole structures of the sole 14, and define a stud electrical connection point or "node". The looped wires 42*a*, 42*b*, 42*c* are held in place by a layer of conductive tape or fabric 46, again preferably a copper or silver-based tape or fabric material, as best shown in FIG. 1. In a preferred embodiment, an embossed copper tape, with an acrylic pressure sensitive adhesive and liner, is utilised. The embossing ensuring that an excellent electrical contact is made even through the adhesive.

To provide comfort when in use, an insole 48 is then placed on the top of the layer of conductive tape 46. The insole 48 provides a cushioning layer and which can be formed from a woven fabric material that includes a conductive yarn selected from the group consisting, but not limited to, any one of the following: strands of copper, silver, carbon fibre and combinations thereof. The above list is no way intended to be limiting and exhaustive. The insole 48 also being anatomically shaped to the foot of the user 100 when in use.

As best shown in FIG. 2, each of the pair of studs (a pair of studs being a stud 22*a* as an electrically conductive portion and corresponding stud 22*a* as an adjacent electrically conductive portion, another pair of studs being another stud 22*b*, 22*c* as another electrically conductive portion and corresponding another stud 22*b*, 22*c* as another adjacent electrically conductive portion) is connected by a loop of conductive wire 42*a*, 42*b*, 42*c*, respectively. The conductive wire loops 42*a*, 42*b*, 42*c* are configured to maximise the point of contact with the conductive tape 46 (not shown for clarity reasons in FIG. 2) and are C- or U-shaped. The skilled person will also appreciate that an asymmetrical or other convoluted routes 42*a*'" or paths can also be utilised by the conductive wire 42*a*, 42*b*, 42*c* to increase the electrical point of contact.

For optimum performance of the present invention it is suggested that the individual 100 wear socks 56 that are made from a woven fabric material that includes a conductive yarn selected from the group consisting, but not limited to, any one of the following: strands of copper, silver, carbon fibre and combinations thereof.

The shoe 10 in this exemplary embodiment of the invention is described in relation to a screw studded football shoe, but can be adapted or adopted in any modern sports footwear that includes a screw stud 22 selected from the group consisting, but not limited to, any one of the following: golf shoes, rugby boots, American football boots, hockey shoes, running spikes etc. The above list is no way intended to be limiting and exhaustive. In order to adapt this technology into other areas of sport or leisure only minor alterations will occur, but these are entirely within the scope of the present invention. Use of the present invention enabling an electrical conduction path to ground to harness the negatively charged electrons and ions carried in the earth and which flow freely from the ground up through the footwear 10, and any sock 56 or foot garment onto the surface of the user's 100 skin.

Use of the screw studded football shoe 10 according to the exemplary embodiment of the invention shown in FIGS. 1 to 3 has been found to significantly reduce the electric field induced voltage on subject's bodies. A simple, but effective, measurement can be made by the use of a digital multimeter. The electric field was firstly measured on a subject's body whilst being in direct contact with grass, and this was found to be around −100 mV. The same subject, using the screw studded footwear 10 as described in relation to FIGS. 1 to 3, was found to have a measured electric field of around −750 mV. Without wishing to be limited by a theory, it is understood that this larger negative potential is indicative of an effective electrical conduction path or contact to ground, and which allows the user 100 to harness or infuse the negatively charged electrons and ions carried in abundance in the earth. These negatively charged electrons and ions flow freely from the ground up through the footwear 10, and any sock 56 or foot garment onto the surface of the user's 100 skin.

Figure 4:
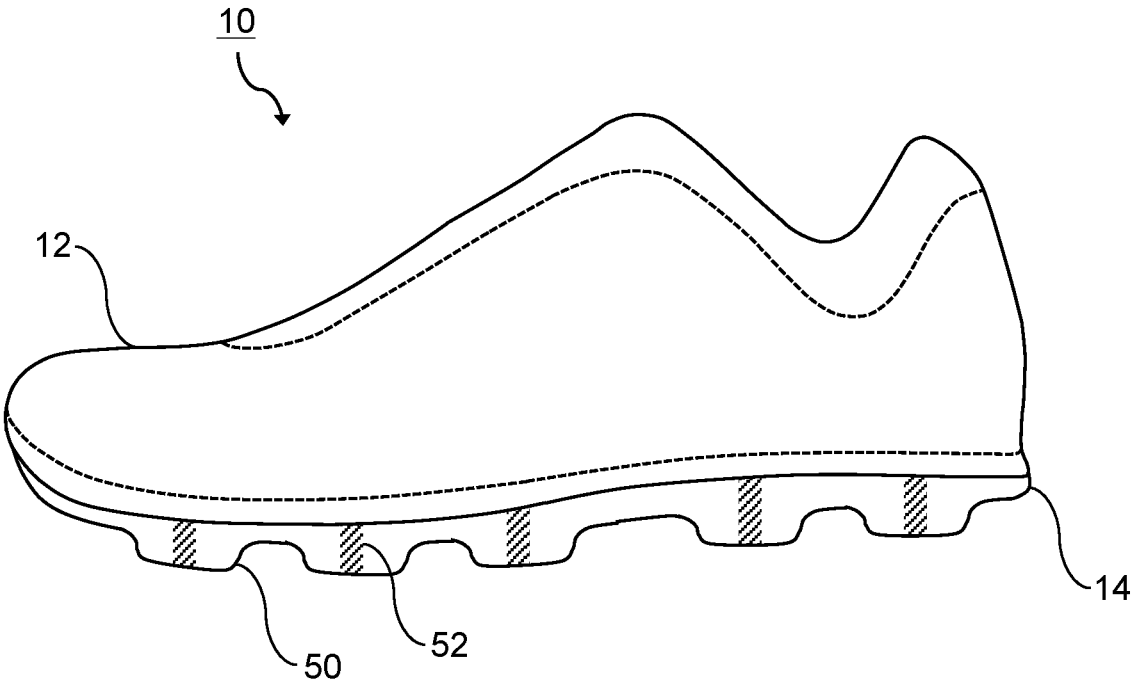
FIG. 4 is a side schematic view of a second embodiment of the present invention which is configured as a bladed football shoe.

FIG. 4 shows a second embodiment of the shoe 10. The construction of the second embodiment is very similar to that of the first embodiment and corresponding features have been given the same reference numerals. The second embodiment differs from the first embodiment in that instead of footwear 10 having separate screw studs 22 being inserted in the sole 14, the shoe 10 includes moulded blades 50, projections or studs, as sole structures of the sole, that are integrally formed with the sole 14. Adapting the present invention for football shoes 10 with rubber moulded studs or blades 50 necessitates making a small incision (not shown in FIG. 4) above and adjacent the moulded blade 50 and a small hole would be made from the outermost part of the blade 50 to the inner sole face 18. A thin piece or section of conductive material 52, such as copper, silver or silver plated or coated steel, or an alloy or mixtures thereof, would be inserted creating an electrical conduction path. This can be retained in place in the blade 50 via an interference fit or adhered in place using a suitable adhesive. Such a configuration enabling the electrical connection between the ground and insole 48 to occur, as with the embodiment of FIGS. 1 to 3.

Alternatively, the conductive piece 52 in the blade 50 could be formed using an electrically conductive layer. This can be achieved by placing a thin film of metal onto a plastic material forming the sole 14 and mixing it into the polymer surface with an ion beam. This alternative method can be used to form conductive plastic films, and utilised to make portions or channels 52 of the in-moulded blades 50 electrically conductive.

Figure 5:
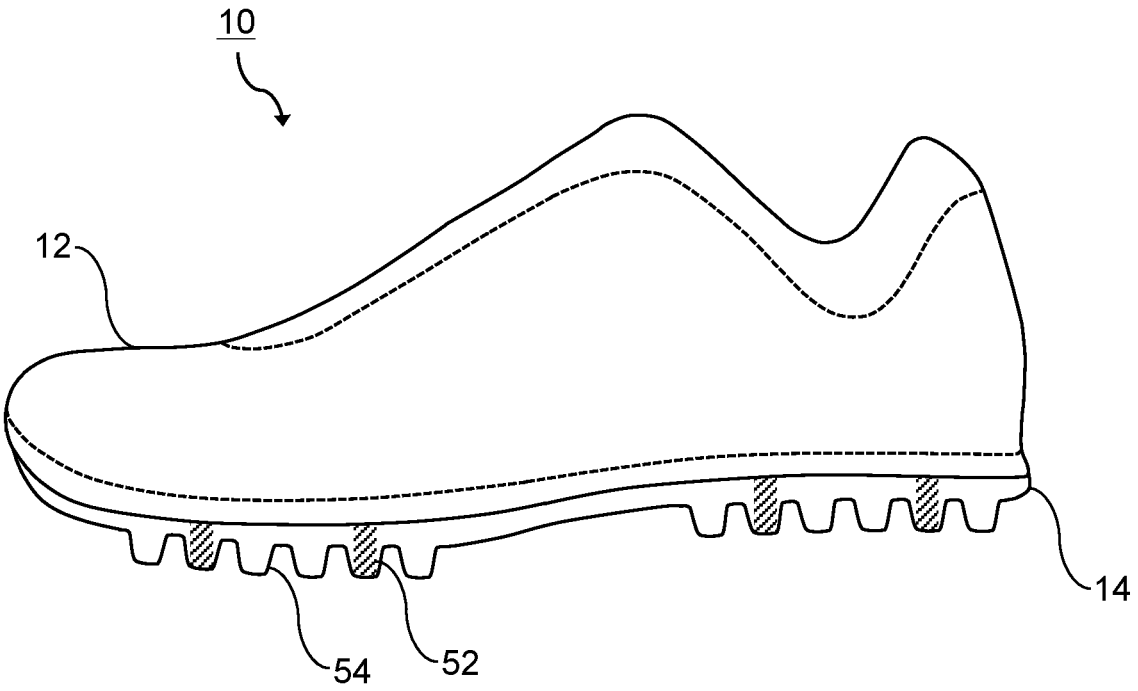
FIG. 5 shows a side schematic view of the footwear of FIG. 4 which is configured for use as a golf shoe.

The present invention can work within many different types of sports and leisure footwear. For example, FIG. 5 shows how the present invention can be configured as a tennis or golf shoe 10. Very much like FIG. 4, the conductive rods 52 would be inserted directly into the sole 14 of the shoe 10 through the projections 54 and the looped wires 42 (not shown in FIG. 5 for clarity reasons) would connect to the uppermost end of the rods 52 though the inner sole face 18.

Figure 6:
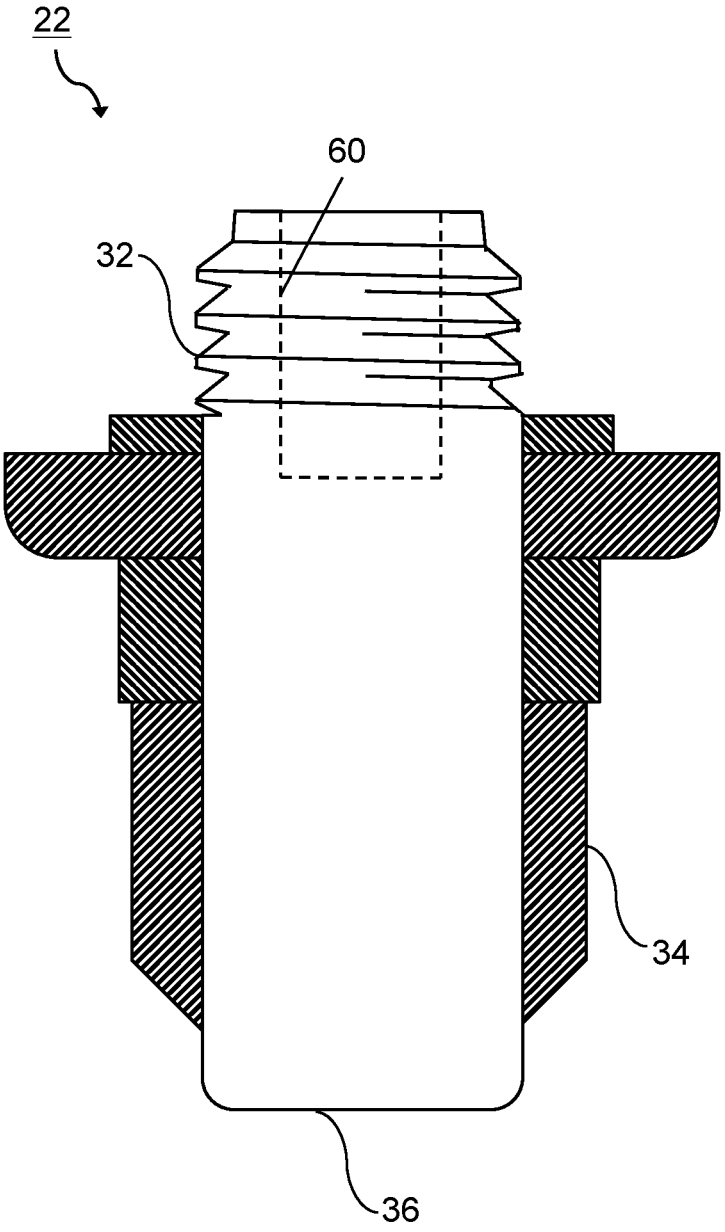
FIG. 6 illustrates a cross-sectional view from the side of a third embodiment of the present invention which shows a screw stud for use with the footwear of FIG. 1.

FIG. 6 shows a third embodiment of a screw stud 22 for use with footwear 10. The construction of the third embodiment is very similar to that of the first and second embodiments and corresponding features have been given the same reference numerals. The third embodiment differs from the first and second embodiments in that instead of a low-profile lug 40 extending from the threaded end 32 at the top of the shaft 38, the shaft 38 of the screw stud 22 features a blind hole 60. The blind hole 60 is disposed at the top of the shaft 38 enabling the electrical connection of the looped wire 42 to the stud 22 usually by way of soldering the wire 42 (not shown) inside the blind hole 60. This is a simple and effective way of connecting the wire loop 42 to the stud 22.

The shoe 10 of the present invention is considered particularly beneficial for sportspersons who are prone to injury or who suffer from reoccurring chronic conditions. What is apparent is that with all embodiments of the invention is that the conductive shaft 38 formed in the outwardly projecting screw studs 22 with a body portion 34 for the shaft 38, or the conductive pieces 52 formed in the outwardly projecting integrally-moulded blades 50 or projections 54 of the shoe 10 allow any extraneous static electricity, positive ions and other electromagnetic fields and charges that are otherwise present in the individual 100 to be naturally dissipated to the ground when that person in engaged in sports or leisure activities.

The skilled person will understand that the present invention could also be configured such that the material forming the upper 12 of the shoe 10 is also made from a conductive fabric material, as described above in relation to the insole 48.

A soluble coating 12A which could incorporate a conductive compound, such as silver ion solution in its composition, could also be applied to the outer layer of the shoe 10, the upper 12 and the sole 14 to create a waterproof and conductive coating which enhances the grounding effects described herein.

The skilled person will understand that aspects of the invention, and particularly the features of the looped wire 42 in contact with, or sandwiched between layers of conductive tape 46, adjacent to one or more layers of conductive woven fabric material 48A of an insole 48 could be isolated from the footwear 10, and instead embodied as an electrically grounded conductive mat or pad. The mat or pad could be connected to a separate ground connection or rod via a grounding wire connection for use in indoor sports activities, such as in a gym, or for post-exercise sports treatment and rehabilitation, as part of a massage table.

Preliminary studies of professional footballers using thermal imaging analysis has revealed that use of the present invention, even over short periods of time, markedly improves blood and lymphatic circulation which, in turn, reduces pain and inflammation and aids recovery.

The invention is not intended to be limited to the details of the embodiments described herein, which are described by way of example only. Various additions and alternations may be made to the present invention without departing from the scope of the invention. For example, although particular embodiments refer to implementing the present invention with football shoes or boots, this is in no way intended to be limiting as, in use, the present invention can be applied to any type of footwear. It will be understood that features described in relation to any particular embodiment can be featured in combination with other embodiments.

We claim:

1. An article of footwear for grounding a human body to earth, comprising:

an upper;

a sole having an outer sole face distal to said upper and an inner sole face proximate to said upper;

an electrically conductive portion extending through said sole from said outer sole face toward said inner sole face; and an electrically conductive layer extending over a portion of said inner sole face, wherein said electrically conductive portion has a body portion and a shaft being disposed through said body portion, said body portion and said shaft outwardly projecting from said outer sole face so as to form an electrical conduction path to ground relationship from said inner sole face to said shaft through said electrically conductive layer, wherein said sole comprises a stud receiving portion, and wherein said electrically conductive portion is a threaded screw stud being comprised of a threaded retaining insert, said body portion, and said shaft being disposed through said body portion and having a threaded end removably engaged with said sole structure and an exposed ground contacting portion end opposite said threaded end, said body portion having a truncated cone shape.

2. The article of footwear as claimed in claim 1, wherein said stud receiving portion is molded within material of said sole.

3. The article of footwear as claimed in claim 1, wherein said body portion comprises projections so as to engage with a complementary shaped tool.

4. The article of footwear as claimed in claim 1, wherein said body portion comprises an annular shoulder, wherein said stud receiving portion has an outer face, and wherein said annular shoulder has a fully screwed position with said outer face meeting said annular shoulder.

5. The article of footwear as claimed in claim 1, wherein said electrically conductive layer comprises a layer of conductive tape, the article further comprising:

an insole being positioned above said layer of conductive tape and being comprised of a cushioning layer formed from a woven fabric material, said woven fabric material being comprised of a conductive yarn.

6. The article of footwear as claimed in claim 1, further comprising: a soluble coating being applied to said upper and said sole, said soluble coating being comprised of a conductive compound.

7. An article of footwear for grounding a human body to earth, the article comprising:

an upper;

a sole having an outer sole face distal to said upper and an inner sole face proximate to said upper;

an electrically conductive portion extending through said sole from said outer sole face toward said inner sole face, wherein said electrically conductive portion is a threaded screw stud being comprised of a threaded retaining insert, a body portion, and a shaft being disposed through said body portion and having a threaded end removably engaged within said sole structure and an exposed ground contacting portion end opposite said threaded end, said body portion having a truncated cone shape; and an electrically conductive layer extending over a portion of said inner sole face so as to form an electrical conduction path to ground relationship from said inner sole face to said shaft through said electrically conductive layer, wherein said sole comprises a stud receiving portion; and a slit in said inner sole face, said electrically conductive portion extending through the stud receiving portion, wherein said threaded end has a lug having a projection positioned through said slit in said inner sole face.

8. The article of footwear as claimed in claim 7, further comprising: a conductive wire having one wire end connected to said lug so as to form at least one electrical connection of a group consisting of: a physical spade connection, a crimp connection, and a soldered connection.

9. The article of footwear as claimed in claim 8, further comprising: an adjacent electrically conductive portion extending through said sole from said outer sole face toward said inner sole face, wherein said conductive wire has another wire end connected to said adjacent electrically conductive portion so as to form a loop.

10. The article of footwear as claimed in claim 9, wherein said loop is positioned in a flat configuration aligned with said inner sole face.

11. The article of footwear as claimed in claim 9, further comprising: another electrically conductive portion extending through said sole from said outer sole face toward said inner sole face; and another adjacent electrically conductive portion extending through said sole from said outer sole face toward said inner sole face so as to form another loop between said another electrically conductive portion and said another adjacent conductive portion, wherein said loop and said another loop are positioned adjacent to said inner sole face.

12. The article of footwear as claimed in claim 11, wherein said sole is comprised of a heel portion, and an instep portion, said loop being in said heel portion, said another loop being in said instep portion.

13. The article of footwear as claimed in claim 9, wherein said loop has a convoluted path.

* * * * *